United States Patent [19]

Lee

[11] Patent Number: 4,673,907

[45] Date of Patent: Jun. 16, 1987

[54] TRANSFORMER WITH AMORPHOUS ALLOY CORE HAVING CHIP CONTAINMENT MEANS

[75] Inventor: Albert C. Lee, Hickory, N.C.

[73] Assignee: General Electric Company, King of Prussia, Pa.

[21] Appl. No.: 883,480

[22] Filed: Jul. 15, 1986

Related U.S. Application Data

[63] Continuation of Ser. No. 810,664, Dec. 19, 1985, abandoned.

[51] Int. Cl.[4] ..... H01F 27/26; H01F 27/30

[52] U.S. Cl. ..... 336/92; 336/197; 336/210; 336/217

[58] Field of Search ..... 336/90, 92, 94, 58, 336/197, 210, 216, 217, 233, 234

[56] References Cited

U.S. PATENT DOCUMENTS 3,742,312 6/1973 Hillyard ..... 336/92 X

FOREIGN PATENT DOCUMENTS 663569 12/1951 United Kingdom ..... 336/210

*Primary Examiner*—Thomas J. Kozma

*Attorney, Agent, or Firm*—William Freedman; Henry J. Policinski

[57] ABSTRACT

A transformer comprises a tank containing insulating liquid, and within the liquid there is an amorphous-alloy laminated core that comprises spaced-apart upper and lower yokes and two spaced-apart legs at opposite ends of the yokes. Coil structure surrounds the legs, locating the yokes outside the coil structure. Box-like enclosures primarily of electrical insulating material respectively enclose the yokes in positions outside the coil structure. The enclosure about the lower yoke is positioned to capture therein chips of amorphous alloy which might become detached from said core and fall toward the bottom of the tank.

14 Claims, 7 Drawing Figures

TRANSFORMER WITH AMORPHOUS ALLOY CORE HAVING CHIP CONTAINMENT MEANS

This application is a continuation of application Ser. No. 810,664 filed Dec. 19, 1985.

BACKROUND

This invention relates to an electric transformer and, more particularly, to a transformer having a core of amorphous ferromagnetic alloy.

Traditionally, the cores of electric transformers have been made of grain-oriented silicon steel laminations. In recent years, however, amorphous ferromagnetic alloy has been proposed for such use in order to decrease core operating losses. This amorphous alloy is available in the form of very thin strip material which is quite brittle, especially after annealing. Using this strip material for core laminations, it is very difficult to make a laminated amorphous alloy transformer core without some chipping or breaking of the edges of the core laminations. Most such chips can be removed during the manufacturing process, but there is a chance that a small quantity will appear or be developed later.

The presence of loose metal chips in a transformer is very undesirable since such chips can deposit on and short out winding insulation and can reduce the dielectric strength of the insulating oil in the transformer. Either of these conditions can lead to a failure of the transformer.

OBJECTS AND SUMMARY

An object of my invention is to capture and contain any metal chips detached from the amorphous alloy core and unremoved during the manufacturing process, in a location where the chips will not produce the above described failures.

Another object is to provide simple, inexpensive, and effective means for capturing and containing such chips.

In carrying our the invention in one form, I provide a transformer that comprises a tank containing insulating liquid. Within the liquid there is an amorphous alloy core comprising spaced-apart upper and lower yokes and two spaced-apart legs at opposite ends of the yokes. Coil structure surrounds the legs, locating the yokes outside the coil structure. A box-like enclosure primarily of electrical insulating material encloses the lower yoke in a position outside the coil structure and is positioned to capture therein chips of amorphous alloy which might become detached from said core and fall toward the bottom of the tank.

BRIEF DESCRIPTION OF THE DRAWINGS

For a better understanding of the invention, reference may be had to the following specification in conjunction with accompanying drawings, wherein.

DETAILED DESCRIPTION OF PREFERRED EMBODIMENT

Figure 1:
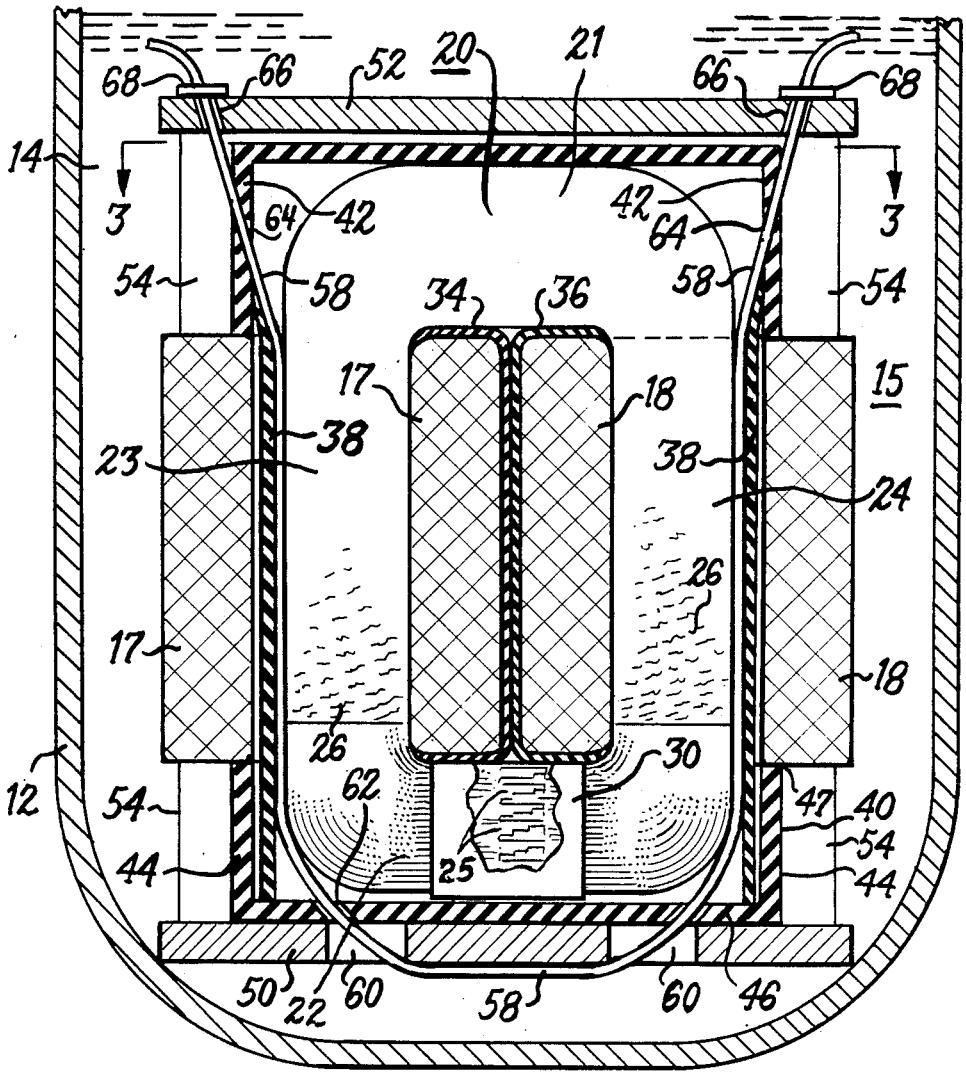
FIG. 1 is a front elevational view, partly in section and partly schematic, of a core-type transformer embodying one form of my invention.

Referring now to FIG. 1, the transformer shown therein is a distribution transformer comprising a metal tank or enclosure 12 containing an insulating liquid 14. Within the insulating liquid is the core and coil assembly 15 of the transformer.

This assembly 15 comprises two coils 17 and 18 and a wound laminated core 20 of amorphous ferromagnetic alloy linked to the coils. Prior to its incorporation into assembly 15, the core 20 is made from amorphous alloy in strip form, such as that commercially available from Allied Corporation as its Metglas 2506-S2 material. The core may be made in any number of different ways, but the illustrated core is preferably made by winding the amorphous strip into an annular form (not shown), cutting the annular form along a single radial line thereby creating separate laminations, and then reassembling the laminations to form a second annulus (not shown) with distributed gap joints in a localized region of the second annulus. Then the second annulus is formed into the generally rectangular shape shown in FIG. 1, so that it comprises four integrally-connected sides consisting of two yokes 21 and 22 and two legs 23 and 24 at opposite ends of the yokes, with the joints (shown at 25) being located in yoke 22. After this forming step, the core is annealed to relieve the stresses resulting from the earlier fabrication steps. Then, a thin layer of adhesive bonding agent, shown at 26 in FIG. 1, is applied to the lateral edges of the laminations in the upper yoke 21 and in the two legs 23 and 24. The lower yoke 22 and the corner regions of the core at opposite ends of the lower yoke are kept free of this bonding agent in order to permit ready displacement of these core portions during subsequent lacing of the core into the coils. After bonding, the joints 25 are opened, and the portions of the yoke at opposite sides of the joints 25 are displaced into positions of alignment with the legs 23 and 24 to convert the core into a U-shaped structure that can be easily laced into the two coils 17 and 18, which had been pre-wound in a conventional manner.

Lacing is accomplished by inserting one leg of the above-described U-shaped core structure into the central passageway of pre-wound tubular winding 17 and the other leg into the central passageway of pre-wound tubular winding 18. Thereafter the displaced yoke portions of the core are returned to their closed-joint positions of FIG. 1 to remake the joints 25. A sleeve of insulating material, preferably a suitable kraft paper, is then applied to the yoke 22 about the region of joints 25. This sleeve is shown at 30 in FIG. 1. Preferably, the sleeve is formed from a sheet of kraft paper which is snugly wrapped around the joint region, following which its ends are taped together.

Before the core is laced into the coils as above described, two channel-shaped insulating members 34 and 36, referred to as core shields, are respectively applied to the coils in the locations shown in FIG. 1. The horizontal flanges of these channel-shaped members act as spacers which prevent the inner surfaces of the yokes 21 and 22 from directly contacting the edges of coils 17 and 18 and thus reducing the dielectric strength of the coil structure. The insulating members 34 and 36 also space and provide insulation between the juxtaposed outer peripheries of the coils 17 and 18. It is to be understood that the high voltage windings of the transformer are located in the radially outer region of each coil 17 and 18, and it is therefore important to maintain a high dielectric strength of the insulation in these regions.

After the core 20 is thus laced into the coils 17 and 18, two thin end panels 38 of suitable insulating material such as kraft paper are respectively inserted into the passageways of coils 17 and 18 adjacent the outer surface of the core legs 23 or 24 already positioned therein. These passageways are of a rectangular cross-section, and this allows the panels 38 to be flat sheets. It will be noted that the panels 38 are sufficiently long that their upper and lower ends extend well beyond the upper and lower ends of the coils 17 and 18, respectively. The purpose of these sheets, or panels 38, will soon be described.

As a next step in the assembly process, two box-like enclosures 40 and 42 are applied to the portions of the core that are then located outside the coils. The bottom enclosure 40 has four vertically-extending walls 44 disposed in a rectangular pattern and a bottom wall 46. The top of this bottom enclosure 40 is open, and this allows the bottom yoke 22 of the core to enter and to fit within the enclosure 40. The upper enclosure 42 is substantially the same as the bottom enclosure 40 except that it is inverted. The open bottom of the upper enclosure 42 allows the upper yoke 21 to enter and to fit within the upper enclosure.

It will be noted that the end panels 38 at their top and bottom ends extend into the enclosures 40 and 42. The panels 38 tend to block any openings (such as might possibly be present at 47) between the lateral end walls of the enclosures 40, 42, and the end surfaces of the coils 17 and 18.

Figure 2:
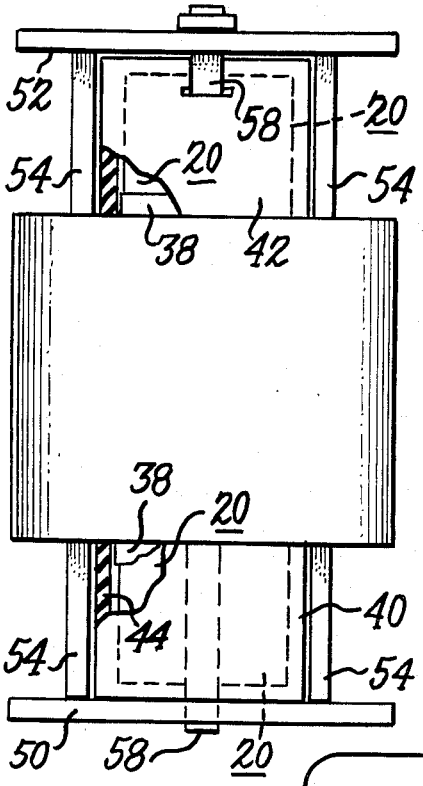
FIG. 2 is an end view of the core and coil assembly of the transformer of FIG. 1.

The next step in the assembly process is to incorporate horizontal top and bottom clamping plates 50 and 52 between which the coil structure 17, 18 is clamped. These horizontal plates 50 and 52 are separated from the coil structure 17, 18 by vertically-extending rigid plates 54 of insulating material. At the upper end of the coil structure 17, 18, two of these plates 54 are disposed perpendicular to the upper horizontal plate 52 and on opposite sides of the upper enclosure 42, as best seen in FIG. 2. At the lower end of the coil structure 17, 18, two of the plates 54 are disposed perpendicular to the lower horizontal plate 50 and on opposite sides of the lower enclosure 40. These vertical plates 54 are disposed closely adjacent the side walls of the enclosures 40 and 42, respectively, and thus tend to impede flow through any cracks or openings present between the side walls and the end surfaces of the coils 17 and 18.

The two horizontal plates 50 and 52 are forced toward each other by forces developed through a flexible clamping band 58, preferably of steel, that is placed in tension. As best seen in FIG. 1, this band extends upwardly through two openings 60 in the bottom horizontal plate 50 and through two slots 62 in the bottom wall of the lower enclosure 40, then upwardly through the passageways of the coils 17 and 18, then through slots 64 in the end walls of the upper enclosure 42 and then through openings 66 in the upper horizontal plate 52. This band 58, which is looped around the portion of bottom horizontal clamping plate 50 between openings 60, is suitably tightened to place it under tension, and suitable clips 68 are applied to its free ends to hold it in its tightened state.

The horizontal clamping plates 50, 52 being forced together by tensile forces in band 58, clamp the coil structure 17, 18 between the vertically-extending insulating plates 54. The vertically-extending plates 54 have sufficient height to avoid applying compressive forces via the enclosures 40 or 42 from the clamping plates to the core 20.

As pointed out in the introductory portion of this specification, the amorphous ferromagnetic alloys that are available today are rather brittle and occasionally break and chip, especially along the edges of any thin strips composed thereof. The illustrated core is made of such strip, and it is therefore possible for some chipping thereof to occur at the edges of such strip, which are located along the core face facing the viewer in FIG. 1 and the parallel back face, as well as at the joints 25. The adhesive coating at 26 provides significant protection against such chipping and helps to contain chips that are developed, but it is not completely effective in this respect in the bonded areas and, moreover, has little effect in the areas not covered by the coating 26, e.g., along the bottom yoke 22 and at the joints 25. Most such chips can be removed during the manufacturing process, but there is a chance that some can appear or be developed later.

The presence of loose chips especially in the insulating liquid 14 is very undesirable because these chips may deposit on the coil insulation and such metal deposits can short out insulation and cause a dielectric failure. Moreover, the presence of metal chips in the insulating liquid impairs the dielectric strength of the insulating liquid itself, and this can lead to a dielectric failure in regions of the insulating liquid where there are high electric stresses.

The box-like enclosures 40 and 42 provide significant protection against such dielectric failures. Any chips that are detached from the core and which fall toward the bottom of the tank 12 are intercepted by and captured within the lower enclosure 40. Some of the finer chips may become entrained in the oil and may tend to move with the oil as it circulates between the bottom and top of the tank as it is heated by the transformer losses in the region of the core and coil assembly and as it cools upon entry into regions remote from the core and coil assembly. The upper enclosure 42 acts as sort of a filter or baffle to block these chips from leaving the core region and from escaping into the surrounding oil regions or onto the high voltage surfaces of the coils, which are located adjacent their outer peripheries.

Figure 3:
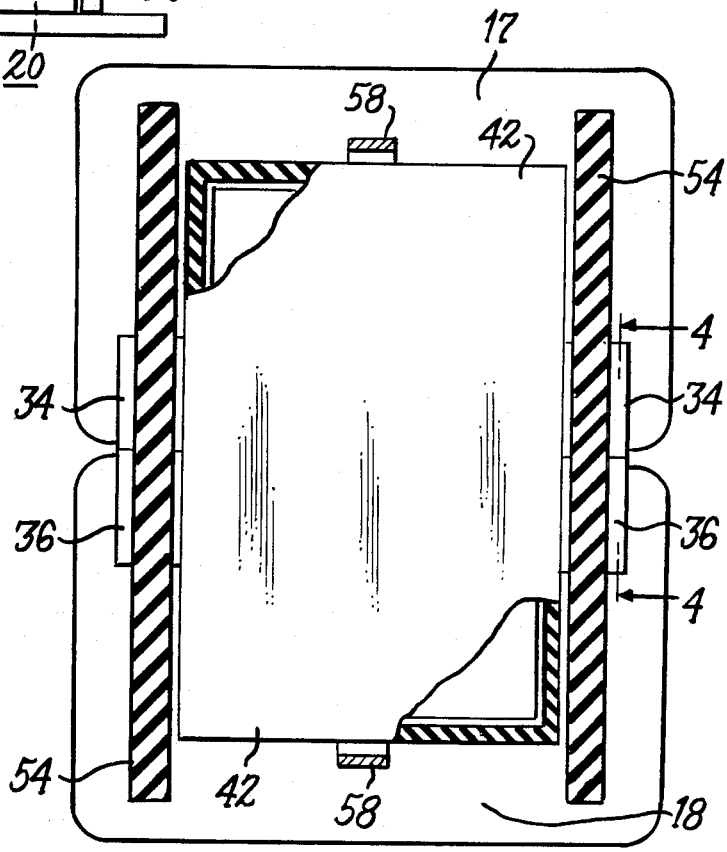
FIG. 3 is a simplified sectional view taken along the line 3—3 of FIG. 1.

The core of the illustrated transformer is connected to ground by suitable means (not shown) and is therefore at ground potential. By confining detached metal chips to the region immediately around the core, the chips are confined for the most part to a region of relatively low electric stress, where their potential for causing dielectric failures is much less. Referring to FIG. 3, it will be seen that the box-like enclosure 42 closely conforms to the rectangular outer perimeter of the core 20 where the core intersects the upper surface of coil structure 17, 18, and thus is capable of providing an effective barrier against escape of chips from the interior of enclosure 42. It will be seen in FIG. 3 that most of the outer peripheral region, which is the high voltage region, of each coil 17 or 18 is outside the perimeter of the box-like enclosure 42 and is thus well isolated from any chips in the interior of enclosure 42. As will be apparent from FIG. 3, there is a limited portion of the outer peripheral region of each coil that is disposed within the enclosure 42. But this limited portion is covered by the upper flanges of the insulating core shields 34 and 36, and any chips resting in this location are separated from the high voltage winding of the coils by these insulating flanges, thus reducing the chances for any resulting dielectric problems.

Figure 4:
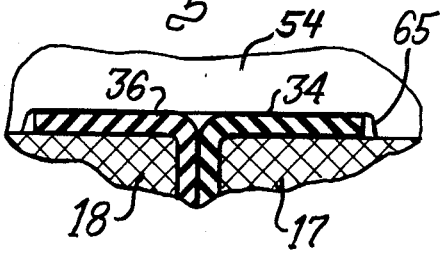
FIG. 4 is an enlarged detailed view taken along the line 4—4 of FIG. 3.

To accommodate these flanges of core shields 34 and 36 without compromising the close fit between the edges of vertical plates 54 and the upper surface of the coil structure 17, 18, the lower edges of the plates 54 are provided with notches for receiving these flanges. One such notch is shown at 65 in FIG. 4, where it can be seen that the notch closely conforms with the outer outline of these flanges to minimize gaps in this region through which chips could escape from the interior of enclosure 42. The lower edges of the walls of enclosure 42 can be provided with similar notches for receiving flanges 34 and 36 and thus improving the fit between these edges and the upper surfaces of coils 17 and 18.

Similar notches are also present in the upper edges of the lower plates 54 and the sidewalls 44 of the lower enclosure 40 for this same purpose.

While I have shown the invention applied to a transformer with a cut-type core, it is to be understood that it is also applicable to the type core that has no cut or joint therein.

Figure 5:
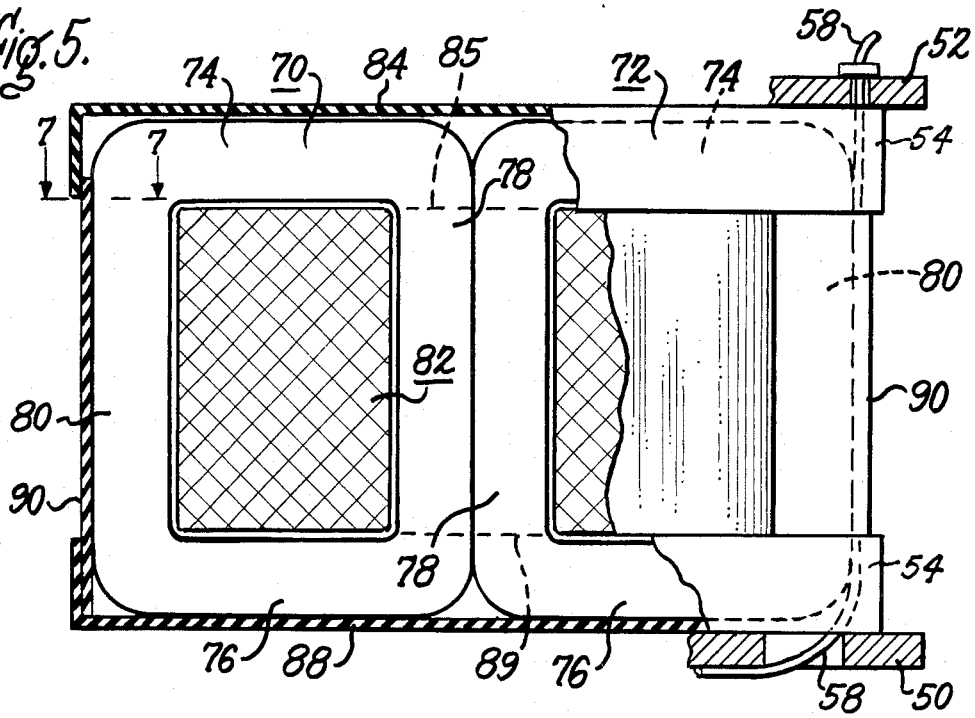
FIG. 5 is a front elevational view, partly in section and partly schematic, of a shell-type transformer embodying one form of my invention.
Figure 6:
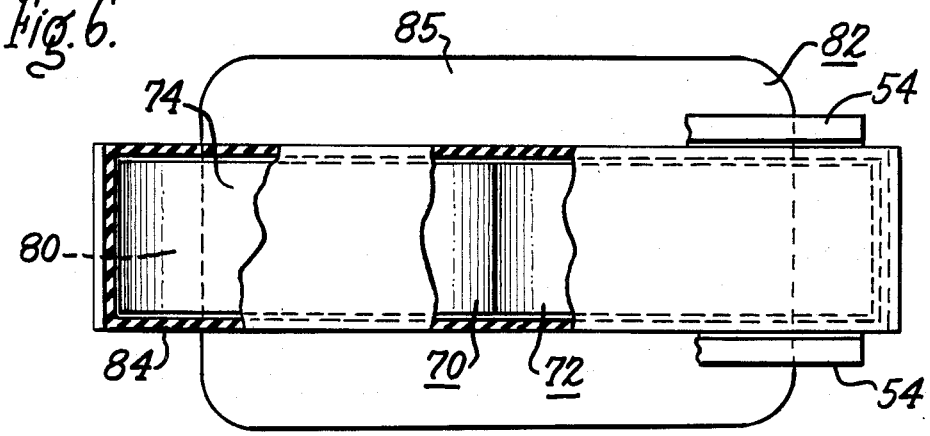
FIG. 6 is a plan view of the assembly of FIG. 5.

This invention in its broader aspects is also applicable to shell-type transformers, as well as to transformers of the core-type, which are depicted in FIGS. 1–4. FIGS. 5 and 6 show a shell-type transformer that comprises two cores 70 and 72, each made from amorphous metal strip and each comprising spaced-apart upper and lower yokes 74 and 76 and two legs 78 and 80 at opposite ends of each yoke. Surrounding one leg 78 of each core is coil structure 82. The other legs 80 of the two cores are located outside the coil structure and at diametrically opposed locations on the coil structure. The yokes 74 and 76 are also located outside the coil structure 72.

The upper yokes 74 are enclosed by a first box-like enclosure 84 of insulating material that is supported on the top surface 85 of the coil structure 82. The lower yokes 76 are enclosed by a second box-like enclosure 88 of insulating material that is supported at the lower surface 89 of the coil structure 82.

Enclosing each of the outer legs 80 of the cores is a panel 90 of U-shaped horizontal cross-section that is suitably supported in the position shown. Each of these panels 90 is longer than the core leg 80 which it encloses and extends at its upper end into the upper enclosure 84 and at its lower end into the lower enclosure 88. Each panel is snugly received by the enclosure into which it extends, and this assures that any gaps between the panel and the enclosure will be small and will not readily allow the passage therethrough of any chips.

Any chips that are detached from the amorphous metal cores 70 and 72 will be captured and contained within the composite enclosure structure made up of enclosures 84 and 88 and panels 90, thus substantially reducing their chances for depositing on the high voltage portion of the coil structure 85 and for becoming entrained in the surrounding oil. The core enclosing structure 84, 88, 90 closely envelopes those portions of the core structure 70, 72 that are outside the coil structure 82 and thus maintains the chips in a location where they have a low likelihood of causing dielectric problems.

Figure 7:
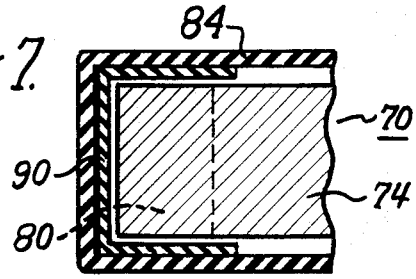
FIG. 7 is a sectional view along the line 7—7 of FIG. 5.

The transformer of FIGS. 5–7 uses essentially the same coil support and clamping means as that of FIGS. 1–4. In this respect, top and bottom horizontal clamping plates 50 and 52 are provided, and a U-shaped band 58 under tension extends between these plates to force them together. Force-transmitting plates 54 at opposite sides of each of the enclosures 84 and 88 transmit clamping force from the horizontal plates 50 and 52 to the coil structure 82. Since parts 50, 52, 54, and 58 are generally the same in the two transformers, they are shown only partially in FIGS. 5 and 6.

While I have shown and described a particular embodiments of my invention, it will be obvious to those skilled in the art that various changes and modifications may be made without departing from my invention in its broader aspects; and I, therefore, intend herein to cover all such changes and modifications as fall within the true spirit and scope of my invention.

What I claim as new and desire to secure by Letters Patent of the United States is:

1. In a transformer that comprises a tank containing insulating liquid, (a) a core within said liquid comprising spaced-apart upper and lower yokes and two spaced-apart legs at opposite ends of said yokes, the core comprising superposed laminations of amorphous ferromagnetic alloy, (b) coil structure surrounding said legs, (c) said yokes being located outside said coil structure, (d) a box-like enclosure primarily of electrical insulating material enclosing said lower yoke in a position outside said coil structure, (e) said enclosure being positioned to capture therein chips of amorphous alloy which might become detached from said core and fall toward the bottom of said tank.

2. The apparatus of claim 1 in which said enclosure closely conforms to the perimeter of said core where the core intersects the lower surface of said coil structure.

3. The apparatus of claim 1 in combination with an additional box-like enclosure primarily of electrical insulating material enclosing said upper yoke and located in a position outside said coil structure.

4. The apparatus of claim 3 in which said additional enclosure closely conforms to the perimeter of said core where the core intersects the upper surface of said coil structure.

5. In the transformer defined in claim 1, (a) bottom and top clamping plates respectively located at opposite ends of said core;

(b) means for forcing said plates toward each other;

(c) means for transmitting force between said plates and said coil structure thereby clamping said coil structure between said plates; and (d) said box-like enclosure being located between said bottom clamping plate and said coil structure.

6. The apparatus of claim 1 in which said core is made of amorphous alloy strip having edges located at the side faces of said core, and an adhesive bonding layer covers most of the area of said side faces and thereby inhibits the development and release of metal chips from the covered area.

7. The apparatus of claim 5 in combination with an additional box-like enclosure enclosing said upper yoke and located in a position outside said coil structure and between said upper clamping plate and said coil structure.

8. The apparatus of claim 1 in which:

(a) said lower yoke contains joints; and (b) a cover of insulating material located within said enclosure closely surrounds said lower yoke and covers said joints to capture chips of amorphous alloy which might be detached from the core in the region of said joints.

9. The apparatus of claim 1 in which:

(a) said coil structure has a passageway therethrough that receives one of said legs, said core has an outer periphery partially located within said passageway, and said enclosure has walls extending into close proximity with said coil structure;

(b) a sheet of insulating material is located adjacent said outer periphery and within said bore, and (c) said sheet extends from said passageway into said box-like enclosure closely adjacent one of the walls of said enclosure, and is thus in a position to inhibit the flow of liquid through any opening between said one wall and said coil structure.

10. The apparatus of claim 5 in which:

(a) said force-transmitting means of (c), claim 5, comprises insulating structure located outside said box-like enclosure and between said bottom clamping plate and said coil structure, and (b) said insulating structure is located closely adjacent predetermined walls of said enclosure and in a position to inhibit the flow of liquid through any opening between said predetermined walls and said coil structure.

11. The apparatus of claim 1 in which said core is at ground potential and said enclosure closely encloses said core so that the space within said enclosure is in a region of relatively low electrical stress within said transformer.

12. In a shell-type transformer that comprises a tank containing insulating liquid, (a) two cores within said liquid, each core comprising spaced-apart upper and lower yokes and two spaced-apart legs at opposite ends of said yokes, each core further comprising superposed laminations of amorphous ferromagnetic alloy, (b) coil structure surrounding one leg of each core and located in a position between the other two legs of said two cores, (c) said yokes and said other two legs being located outside said coil structure, (d) a box-like enclosure primarily of electrical insulating material enclosing said lower yokes in a position outside said coil structure and being positioned to capture therein chips of amorphous metal which might become detached from said core and fall toward the bottom of said tank, (e) an additional box-like enclosure primarily of electrical insulating material enclosing said upper yokes in a position outside said coil structure, and (f) panels primarily of insulating material respectively disposed about the other legs of said cores and extending between said enclosures.

13. The apparatus of claim 12 in which, (a) said first box-like enclosure closely conforms to the perimeter of the two cores taken together where said two cores intersect the lower surface of said coil structure, and (b) said additional box-like enclosure closely conforms to the perimeter of the two cores taken together where the two cores intersect the upper surface of said coil structure.

14. In the transformer of claim 12, (a) bottom and top clamping plates respectively located at opposite ends of said two cores, (b) means for forcing said plates toward each other, (c) means for transmitting force between said plates and said coil structure thereby clamping said coil structure between said plates, and (d) said box-like enclosures being respectively located between said bottom clamping plate and said coil structure and said top clamping plate and said coil structure.

* * * * *